US007451815B2

(12) United States Patent
Hailey, Jr.

(10) Patent No.: US 7,451,815 B2
(45) Date of Patent: Nov. 18, 2008

(54) SAND CONTROL SCREEN ASSEMBLY ENHANCED WITH DISAPPEARING SLEEVE AND BURST DISC

(75) Inventor: Travis T. Hailey, Jr., Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 170 days.

(21) Appl. No.: 11/209,250

(22) Filed: Aug. 22, 2005

(65) Prior Publication Data

US 2007/0039741 A1 Feb. 22, 2007

(51) Int. Cl.
*E21B 43/08* (2006.01)

(52) U.S. Cl. ..... 166/278; 166/376; 166/227; 166/229

(58) Field of Classification Search ..... 166/376, 166/228, 227, 235, 326, 378, 380, 115, 116, 166/141, 229, 278
See application file for complete search history.

(56) References Cited

U.S. PATENT DOCUMENTS

| | | | | |
|---|---|---|---|---|
| 1,229,437 | A | 6/1917 | Foster | 210/458 |
| 2,224,630 | A | 12/1940 | Dean et al. | 166/205 |
| 2,401,035 | A | 5/1946 | Akeyson et al. | 166/205 |
| 2,981,332 | A | 4/1961 | Miller et al. | 166/276 |
| 2,981,333 | A | 4/1961 | Miller et al. | 166/276 |
| 3,099,318 | A | 7/1963 | Miller et al. | 166/227 |
| 3,216,497 | A | 11/1965 | Howard et al. | 166/278 |
| 3,361,203 | A | 1/1968 | Rensvold | 166/376 |
| 3,386,510 | A | 6/1968 | Schnabel, Jr. | |
| 3,880,233 | A | 4/1975 | Muecke et al. | 166/205 |
| 3,999,608 | A | 12/1976 | Smith | 166/278 |
| 4,202,411 | A | 5/1980 | Sharp et al. | 166/244.1 |
| 5,062,484 | A | 11/1991 | Schroeder, Jr. | 166/278 |
| 5,234,055 | A | 8/1993 | Cornette | 166/278 |
| 5,279,370 | A | 1/1994 | Brandell et al. | 166/386 |
| 5,287,923 | A | 2/1994 | Cornette et al. | 166/278 |

(Continued)

FOREIGN PATENT DOCUMENTS

EP 1 350 921 A2 10/2003

(Continued)

OTHER PUBLICATIONS

International Search Report re PCT/US2006/032160 filed Aug. 16, 2006.

(Continued)

*Primary Examiner*—David J. Bagnell
*Assistant Examiner*—David Andrews
(74) *Attorney, Agent, or Firm*—Luke K. Pedersen

(57) ABSTRACT

A sand control screen assembly for use in a wellbore includes a tubular base pipe having a first perforated section. The first perforated section has at least a first opening that allows fluid flow therethrough. The assembly also includes an internal seal element disposed within an internal diameter of the tubular base pipe and positioned at least partially overlapping the first perforated section. The internal seal element is able to control fluid flow through the first opening. The internal seal element includes a first material that is dissolvable by a first solvent, and may be dissolved by exposing the internal seal element to the first solvent until the internal seal element no longer controls fluid flow through the first opening.

21 Claims, 7 Drawing Sheets

U.S. PATENT DOCUMENTS

| | | | | |
|---|---|---|---|---|
| 5,310,000 | A | 5/1994 | Arterbury et al. | 166/296 |
| 5,320,178 | A | 6/1994 | Cornette | 175/19 |
| 5,355,956 | A | 10/1994 | Restarick | 166/296 |
| 5,829,520 | A | 11/1998 | Johnson | 166/250.01 |
| 6,263,972 | B1 | 7/2001 | Richard et al. | 166/381 |
| 6,394,185 | B1 | 5/2002 | Constien | 166/296 |
| 6,397,949 | B1 | 6/2002 | Walker et al. | 166/374 |
| 6,523,611 | B1 | 2/2003 | Bakker et al. | 166/298 |
| 6,599,863 | B1 | 7/2003 | Palmer et al. | 507/219 |
| 6,719,051 | B2 | 4/2004 | Hailey, Jr. et al. | 166/278 |
| 6,772,837 | B2 * | 8/2004 | Dusterhoft et al. | 166/278 |
| 6,857,476 | B2 | 2/2005 | Richards | 166/278 |
| 2002/0142919 | A1 | 10/2002 | Constien | 507/100 |
| 2003/0060374 | A1 | 3/2003 | Cooke, Jr. | 507/200 |
| 2003/0075324 | A1 | 4/2003 | Dusterhoft et al. | 166/279 |
| 2004/0035578 | A1 | 2/2004 | Ross et al. | 166/250.15 |
| 2004/0035591 | A1 | 2/2004 | Echols | 166/386 |
| 2004/0040723 | A1 | 3/2004 | Hovem | 166/384 |
| 2004/0055747 | A1 | 3/2004 | Lee | 166/278 |
| 2004/0134656 | A1 * | 7/2004 | Richards | 166/276 |
| 2004/0186204 | A1 | 9/2004 | Todd | 507/200 |
| 2005/0121192 | A1 | 6/2005 | Hailey, Jr. et al. | 166/278 |

FOREIGN PATENT DOCUMENTS

| | | | |
|---|---|---|---|
| GB | 2 316 024 | A | 2/1998 |
| GB | 2 327 445 | A | 1/1999 |
| GB | 2 343 241 | A | 5/2000 |
| WO | WO 01/92681 | A1 | 12/2001 |
| WO | WO/2005/012689 | A1 | 2/2005 |

OTHER PUBLICATIONS

Baker Hughes sales information, "catEXX™ System Expansion Method," 6 pages.

Enventure Literature, "SET™ Technology: The Facts," 28 pages, 2003.

Simonds, Halliburton Energy Services, Inc., "Expandable Sand Screen Technology Offers Improved Completion Efficiency and Reliability," 19 pages, 2003.

Notification of Transmittal of the International Search Report or the Declaration (PCT Rule 44.1) mailed Apr. 6, 2005 (14 pages) re International Application No. PCT/US2005/000801.

Munoz Jr., U.S. Appl. No. 10/609,031, entitled "Methods of Diverting Treating Fluids in Subterranean Zones and Degradable Diverting Materials," Filed Jun. 27, 2003.

Completion Products and Services, "Screen Communication System," http://www.bjservices.com/completions.nsf.

BJ Services, "Intelligent Completion Systems," http://www.bjservices.com/website/Completions.nsf/sI/IntelligentCompletionSystems?ope.

Completion Equipment, http://www.halliburton.com/esg/sd0912e.jsp.

* cited by examiner

SAND CONTROL SCREEN ASSEMBLY ENHANCED WITH DISAPPEARING SLEEVE AND BURST DISC

TECHNICAL FIELD OF THE INVENTION

This invention relates generally to oil well completion and, in particular, to a sand control screen assembly enhanced with disappearing sleeve and burst disc.

BACKGROUND

It is well known in the field of subterranean well drilling and completion that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded, is then pumped down the work string and into the well annulus formed between the sand control screen and the perforated well casing or open hole production zone.

The liquid carrier either flows into the formation, returns to the surface by flowing through a wash pipe, or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

In other cases, it may be desirable to stimulate the formation by, for example, performing a formation fracturing and propping operation prior to or simultaneously with the gravel packing operation. Hydraulic fracturing of a hydrocarbon formation is sometimes necessary to increase the permeability of the formation adjacent the wellbore. According to conventional practice, a fracture fluid such as water, oil, oil/water emulsion, gelled water or gelled oil is pumped down the work string with sufficient volume and pressure to open multiple fractures in the production interval. The fracture fluid may carry a suitable propping agent, such as sand, gravel or proppants, into the fractures for the purpose of holding the fractures open following the fracturing operation.

It has been found, however, that following formation treatment operations, the fluid inside the sand control screen tends to leak off into the adjacent formation. This leak off not only results in the loss of the relatively expensive fluid into the formation, but may also result in damage to the gravel pack around the sand control screen and damage to the formation. This fluid leak off is particularly problematic in cases where multiple production intervals within a single wellbore require treatment as the fluid remains in communication with the various formations for an extended period of time.

Existing sand control devices may be expensive and complex tools that must be fit into the relatively restrictive geometry inside a wellbore. The complexity of the tools may make them unreliable. Furthermore, the sizes of the tools (smaller inner diameter for given outer diameter, or larger outer diameter for given inner diameter) may make them undesirable for various applications, such as having an inner diameter that is too small to allow service tools or concentric production equipment to be run inside the screen, or an outer diameter to large to allow effective placement of gravel or frac packs around the device.

SUMMARY

In accordance with the teachings of the present invention, disadvantages and problems associated with managing fluid leak off during completion operations in a production interval of a wellbore have been substantially reduced or eliminated. In particular, the system and method described herein prevent undesirable fluid leak off during wellbore completion while improving the hydrocarbon production rate from the production interval during production.

In accordance with one embodiment of the present invention, a sand control screen assembly for use in a wellbore includes a tubular base pipe having a first perforated section. The first perforated section has at least a first opening that allows fluid flow therethrough. The assembly also includes an internal seal element disposed within an internal diameter of the tubular base pipe and positioned at least partially overlapping the first perforated section. The internal seal element is able to control fluid flow through the first opening. The internal seal element includes a first material that is dissolvable by a first solvent, and may be dissolved by exposing the internal seal element to the first solvent until the internal seal element no longer controls fluid flow through the first opening.

In particular embodiments, the tubular base pipe may have a second perforated section with at least a second opening. The assembly may also include a degradable plug disposed so as to prevent fluid flow through the second opening. The degradable plug may include a second material that is dissolvable by a second solvent, and the degradable plug may be dissolved by exposing the degradable plug to the second solvent until the degradable plug no longer prevents fluid flow through the second opening. In another embodiment, the internal seal element may include at least one longitudinal slit. The longitudinal slit allows fluid flow through the first opening from the exterior to the interior of the tubular base pipe when an exterior fluid pressure outside of the base pipe is sufficiently higher than an interior fluid pressure inside of the base pipe to deform the internal seal element radially inwards and allow fluid flow through the longitudinal slit.

In accordance with another embodiment of the present invention, a sand control screen assembly for use in a wellbore includes a tubular base pipe having a first perforated section with at least a first opening that allows fluid flow therethrough. The assembly also includes a degradable plug disposed so as to prevent fluid flow through the first opening. The degradable plug includes a first material that is dissolvable by a first solvent and the degradable plug may be dissolved by exposing the degradable plug to the first solvent until the degradable plug no longer prevents fluid flow through the first opening.

Technical advantages of certain embodiments of the present invention include a sand control screen assembly and a treatment method that prevent fluid loss into the formation(s) during the completion process and allow for the production of fluids from the formation(s) following the completion process. An internal seal element may prevent treatment fluids from leaking into the formation while other production intervals are being completed or until production is begun. During production, the internal seal element may be radially deformed, thereby allowing production fluids to flow from the exterior of the assembly to the interior.

Another technical advantage of particular embodiments of the present invention may include the ability to increase the rate of production from the production interval by selectively degrading the internal seal element and one or more of a plurality of degradable plugs. The internal seal element and degradable plugs may degrade as a consequence of production, or they may be degraded by solvents which are pumped down the wellbore for the purpose of degrading the internal seal element and degradable plugs. The materials used to fabricate the internal seal element and the degradable plugs will determine the solvent used to degrade them. The internal seal element and degradable plugs may be made from materials that dissolve in the presence of hydrocarbons or water.

An additional technical advantage of particular embodiments of the present invention may include the ability to degrade the internal seal element or degradable plugs at a desired time and rate. One or more burst discs or rupture discs may be incorporated into the assembly. If the rate of production is lower than desired, the pressure in the wellbore may be increased to rupture the discs. The new openings may be used to increase production, or may be used to circulate a solvent over the internal seal element and/or degradable plugs to dissolve them and thereby increase the production rate.

Other technical advantages of the present invention will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

To provide a more complete understanding of the present invention and the features and advantages thereof, reference is made to the following description, taken in conjunction with the accompanying drawings, in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
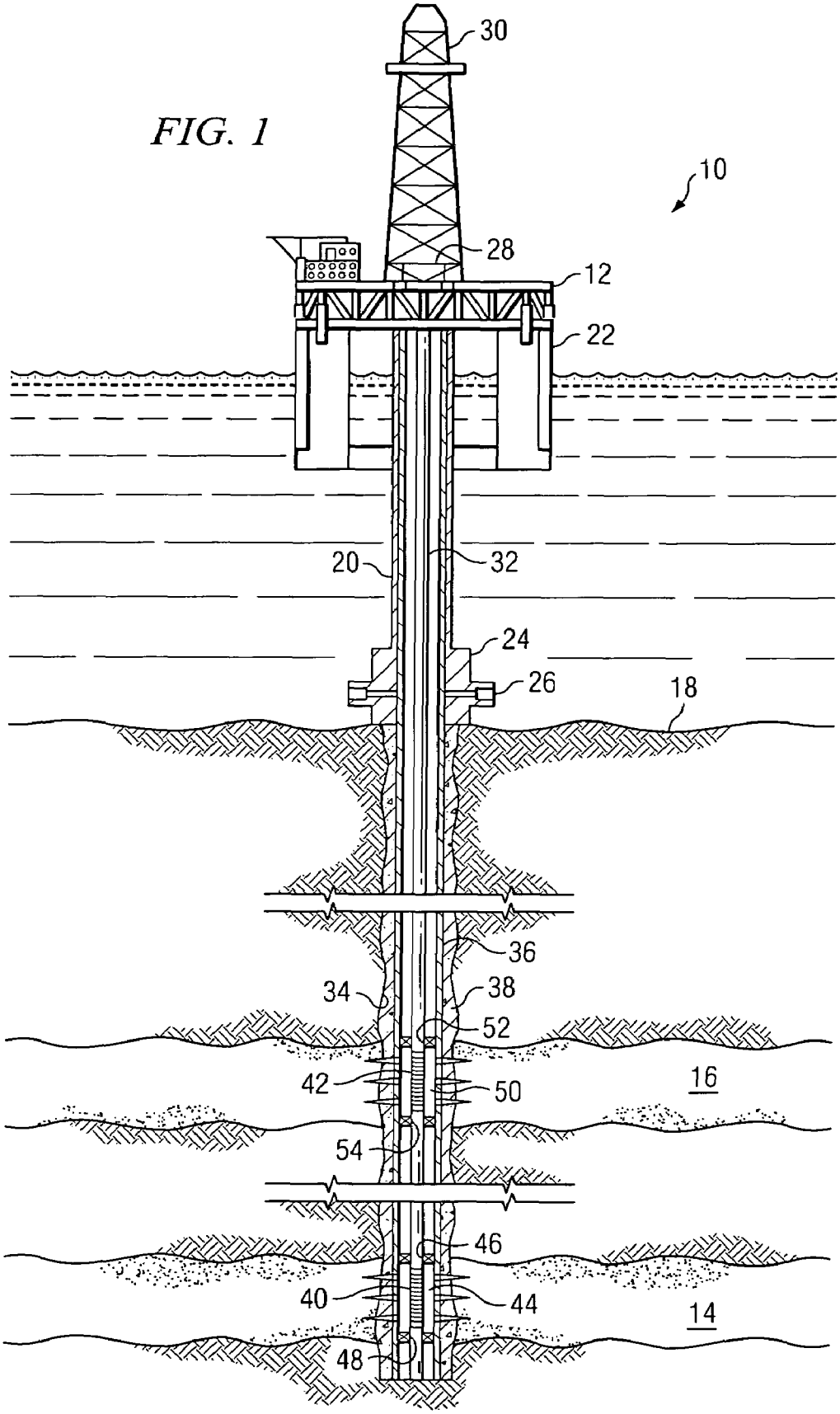
FIG. 1 is a schematic illustration of an offshore oil and gas platform operating a pair of sand control screen assemblies in accordance with the present invention.

Referring initially to FIG. 1, an offshore oil and gas production operation 10 is illustrated with two sand control screen assemblies 40, 42 disposed adjacent two production intervals 44, 50 of a wellbore, respectively. A semi-submersible platform 12 is located over a pair of submerged oil and gas formations 14, 16 located below a sea floor 18. A subsea conduit 20 extends from a deck 22 of the platform 12 to a wellhead installation 24 including blowout preventers 26. Platform 12 has a hoisting apparatus 28 and a derrick 30 for raising and lowering pipe strings such as a work string 32.

A wellbore 34 extends through the various earth strata including formations 14, 16. A casing 36 is cemented within wellbore 34 by cement 38. Work string 32 includes sand control screen assemblies 40, 42. Sand control screen 40 is positioned within production interval 44 between packers 46, 48 adjacent to formation 14. Sand control screen assembly 42 is positioned within production interval 50 between packers 52, 54 adjacent to formation 16. Once sand control screen assemblies 40, 42 have been installed as illustrated, a treatment fluid containing sand, gravel, proppants or the like may be pumped down work string 32 to treat production intervals 44, 50 and formations 14, 16, as described in greater detail below with reference to FIGS. 7-9.

Although FIG. 1 depicts a vertical well, the sand control screen assemblies of the present invention are equally well-suited for use in wells having other directional orientations such as deviated wells, inclined wells or horizontal wells. Also, even though FIG. 1 depicts an offshore operation, the sand control screen assemblies of the present invention are equally well-suited for use in onshore operations. Also, even though FIG. 1 depicts two formations and two production intervals, the treatment processes of the present invention are equally well-suited for use with any number of formations and production intervals.

Figure 2:
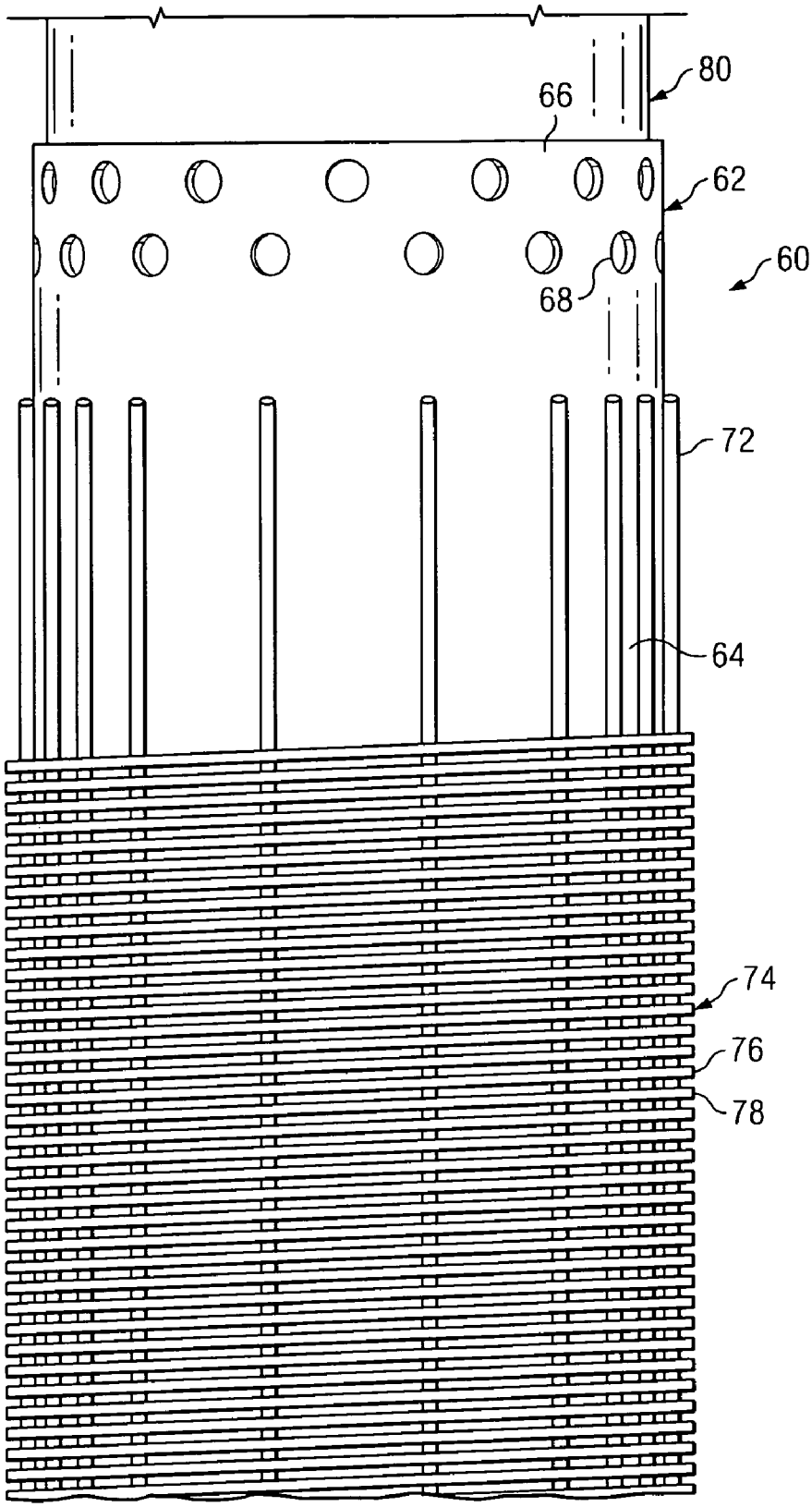
FIG. 2 is a partial cut away view of a sand control screen assembly of the present invention having an internal seal element disposed within a base pipe.

FIG. 2, illustrates a partial cut away view of a sand control screen assembly 60, in accordance with a particular embodiment. Sand control screen assembly 60 includes a base pipe 62 that has a blank pipe section 64 and a perforated section 66 including a plurality of openings 68 that allow the flow of production fluids into sand control screen assembly 60. The exact number, size and shape of openings 68 are not critical to the present invention, so long as sufficient area is provided for fluid production and the integrity of base pipe 62 is maintained. Even though openings 68 are depicted as round holes, other shaped openings including slots, slits, or any other perforation through the wall of base pipe 62 could act as the flow path for fluids into sand control screen assembly 60.

Spaced around base pipe 62 are a plurality of ribs 72. Ribs 72 are generally symmetrically distributed about the axis of base pipe 62. Ribs 72 are depicted as cylindrical rods, however, ribs 72 may have a rectangular or triangular cross section or have any other suitable geometry. Additionally, the exact number and arrangement of ribs 72 is not limited to the number and arrangement illustrated and will vary depending upon the diameter of base pipe 62 as well as other design characteristics that are well known in the art.

Wrapped around ribs 72 is a screen wire 74. Screen wire 74 forms a plurality of turns, such as turn 76 and turn 78. Between each of the turns is a gap through which formation fluids may flow. The number of turns and the gap between the turns are determined based upon the characteristics of the formation from which fluid is being produced and the size of the gravel to be used during the gravel packing operation. Together, ribs 72 and screen wire 74 may form a sand control screen jacket that is attached to base pipe 62 by welding or other suitable technique.

Although FIG. 2 illustrates a wire wrapped sand control screen, other types of filter media could be used as alternatives to or in conjunction with the apparatus of the present invention. Other filter media may include, but are not limited to, a fluid-porous, particulate restricting material such as a plurality of layers of a wire mesh that are diffusion bonded or sintered together to form a porous wire mesh screen designed to allow fluid flow therethrough while preventing the flow of particulate materials of a predetermined size from passing therethrough. In this embodiment, some supporting structure may be required between the wire mesh and the base pipe to create sufficient flow area between the base pipe and the filter media to allow production flow through the entire length of the screen without high friction pressure loss. Alternatively there may be only one layer of wire mesh, or multiple mesh layers may be used without bonding or sintering the layers together. Another filter media could be a packed particulate layer of sand or man-made proppant which is contained between two layers of coarse filter media such as the wire-wrapped media or the wire mesh media previously described.

Positioned within perforated section 66 of base pipe 62 is an internal seal element 80 that prevents fluid flow from the interior to the exterior of sand control screen assembly 60. In particular embodiments, internal seal element 80 may be formed from an elastomer such as a natural or synthetic rubber or other suitable polymer such as a high polymer having the ability to partially or completely recover to its original shape after deforming forces are removed. In other embodiments, internal seal element 80 may be formed from a degradable or dissolvable (collectively "dissolvable") material such as polylactic acid (PLA); a pliable water, oil, or gas soluble resin; or any other suitable dissolvable material. In alternative embodiments, internal seal element 80 may be constructed from any material or have any configuration that allows internal seal element 80 to prevent fluid flow from the interior to the exterior of sand control screen assembly 60 when the pressure inside of sand control screen assembly 60 is greater than the pressure outside of sand control screen assembly 60 and to allow fluid flow from the exterior to the interior of sand control screen assembly 60 when the differential pressure across internal seal element 80 from the exterior to the interior of sand control screen assembly 60 exceeds a predetermined level.

With internal seal element 80 positioned within base pipe 62 during a treatment process, such as a gravel pack, a frac pack or a fracture operation, treatment fluid returns may flow into the interior of sand control screen assembly 60 by deforming internal seal element 80 radially inward away from sealing engagement with the interior of base pipe 62 and openings 68. Also, with internal seal element 80 positioned within base pipe 62 following a treatment process, fluids in the wellbore are prevented from flowing out of sand control screen assembly 60 by deforming internal seal element 80 radially outward into sealing engagement with the interior of base pipe 62 and openings 68.

During production with internal seal element 80 positioned within base pipe 62, production fluids may flow into sand control screen assembly 60 by deforming internal seal element 80 radially inward away from sealing engagement with the interior of base pipe 62 and openings 68. In particular embodiments, the flow of production fluids around internal seal element 80 will dissolve internal seal element 80 until internal seal element 80 can no longer engage the interior of base pipe 62 to seal openings 68. A dissolvable internal seal element 80 may prevent treatment fluids from leaking from the interior of sand control screen assembly 60 during completion or treatment of the wellbore and may dissolve prior to or during production so as not to hamper or decrease the flow rate of the production fluids through openings 68.

Figure 3:
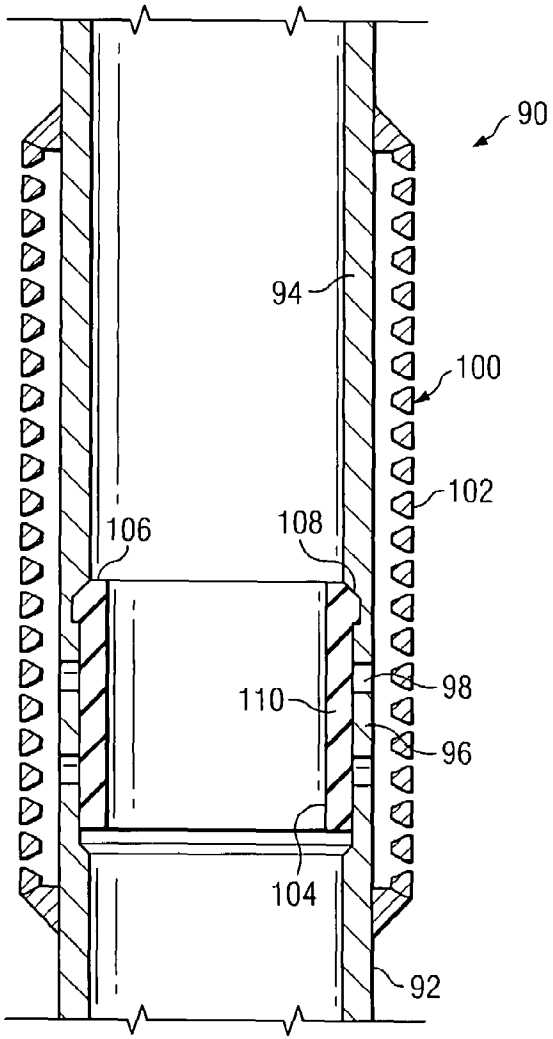
FIG. 3 is a cross sectional view of a sand control screen assembly in accordance with an embodiment of the present invention.

FIG. 3 illustrates a sand control screen assembly 90 in accordance with a particular embodiment of the present invention. Sand control screen assembly 90 includes base pipe 92 that has a blank pipe section 94 and a perforated section 96. Perforated section 96 includes a plurality of openings 98. Positioned on the exterior of base pipe 92 is a sand control screen jacket 100 including a plurality of ribs (not pictured) and a wire screen 102.

Positioned within base pipe 92 is an internal seal element 104 that prevents fluid flow from the interior to the exterior of sand control screen assembly 90 during completion and treatment of a production interval (not illustrated) adjacent sand control screen assembly 90. In the illustrated embodiment, a flared portion 106 of internal seal element 104 is securably mounted within a receiving profile 108 on the interior of blank pipe section 94 of base pipe 92. An adhesive or other suitable bonding agent or method may be used to secure flared portion 106 of internal seal element 104 within receiving profile 108.

A sealing portion 110 of internal seal element 104 is not adhered to base pipe 92 and is radially inwardly deformable away from sealing engagement with the interior of base pipe 92 and openings 98 to allow fluid flow from the exterior to the interior of sand control screen assembly 90. Accordingly, internal seal element 104 allows for treatment fluid returns during a treatment process and for fluid production once the well is online. In addition, internal seal element 104 prevents fluid loss into the formation after the treatment process but before the well is brought online as the fluids within sand control screen assembly 90 deform sealing portion 110 of internal seal element 104 radially outward into sealing engagement with the interior of perforated section 96 of base pipe 92, thereby sealing openings 98.

In the embodiment illustrated in FIG. 3, internal seal element 104 may be formed from a dissolvable material such as polylactic acid (PLA); pliable water, oil, or gas soluble resin; or any other suitable dissolvable material. Internal seal element 104 may be dissolved by exposing internal seal element 104 to a solvent capable of dissolving the material of internal seal element 104. For the purposes of this specification, solvent refers to any fluid capable of dissolving or degrading a target material. Exposing internal seal element 104 to a solvent may include, but is not limited to, circulating the solvent around internal seal element 104, allowing the solvent to remain in contact with internal seal element 104 for a length of time, or, when the solvent is a production fluid, by beginning or continuing production.

The material which internal seal element 104 is formed from will at least partially determine when internal seal element 104 will begin dissolving. Therefore, the material used to form internal seal element 104 may be selected based on a desired life of internal seal element 104. In certain embodiments, the desired life of internal seal element 104 may be approximately one week and internal seal element 104 may comprise polylactic acid that is dissolvable by free water molecules in the surrounding fluid. In another embodiment, internal seal element 104 may comprise an oil-soluble or gas-soluble resin and internal seal element 104 may maintain its check valve functionality until the onset of hydrocarbon production. The presence of internal seal element 104 may result in a decreased flow rate of production fluids through openings 98 because the production fluids need to deform and flow around internal seal element 104. Dissolving internal seal element 104 after completion of the well will result a higher flow rate of the production fluids during production.

In certain embodiments, the material of internal seal element 104 may be dissolved by production fluids such as oil, gas, water, or other fluid present in the formation. Once production has commenced, the fluids being produced will flow around internal seal element 104 thereby dissolving internal seal element 104.

Alternatively, internal seal element 104 may be selectively dissolvable by a fluid or treatment agent other than a production fluid. In this embodiment, a dissolving agent, or solvent, may be pumped downhole from the surface to circulate around and dissolve internal seal element 104. This step may be performed after well completion and before production starts, or it may be completed after production has commenced to increase the flow rate of the production fluids. In particular embodiments, water is not produced from a formation and may be used to selectively dissolve internal seal element 104.

Figure 4:
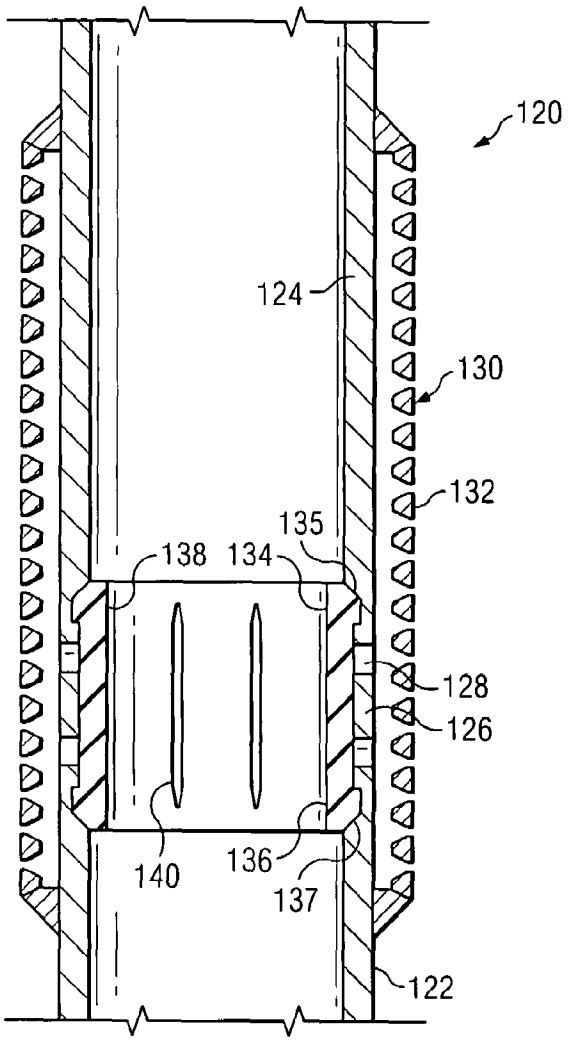
FIG. 4 is a cross sectional view of an alternate embodiment of a sand control screen assembly of the present invention having an internal seal element with longitudinal slits.

FIG. 4 illustrates a sand control screen assembly 120 in accordance with a particular embodiment of the present invention. Sand control screen assembly 120 includes base pipe 122 that has a blank pipe section 124 and a perforated section 126 having a plurality of openings 128. Positioned on the exterior of base pipe 122 is a sand control screen jacket 130 including a plurality of ribs (not pictured) and a screen wire 132.

Positioned within base pipe 122 is an internal seal element 138 that prevents fluid flow from the interior to the exterior of the sand control screen assembly 120. In the illustrated embodiment, a first flared portion 134 of internal seal element 138 is securably mounted within a first receiving profile 135 on the interior of base pipe 122. A second flared portion 136 of internal seal element 138 is securably mounted within a second receiving profile 137 on the interior of base pipe 122. An adhesive or other suitable bonding agent or method may be used to secure first and second flared portions 134, 136 of internal seal element 138 within first and second receiving profiles 135, 137. Internal seal element 138 is also illustrated with a plurality of longitudinal slits 140.

In operation, a middle section of internal seal element 138 between first flared portion 134 and second flared portion 136 is deformable radially inward away from sealing engagement with the interior of perforated section 126 of base pipe 122. When internal seal element 138 is inwardly deformed, slits 140 open and widen to allow fluid flow through openings 128 from the exterior to the interior of sand control screen assembly 120. Internal seal element 138 thereby allows for treatment fluid returns during a treatment process and for fluid production once the well is online. Internal seal element 138 also prevents fluid loss into the formation after the treatment process but before the well is brought online as the fluids within sand control screen assembly 120 deform internal seal element 138 radially outward, thereby closing slits 140 and sealing openings 128.

In particular embodiments, internal seal element 138 may be formed from a dissolvable material such as PLA; pliable water, oil, or gas soluble resin; or any other suitable dissolvable material. In this embodiment, internal seal element 138 may be dissolved in any of the manners discussed above regarding internal seal element 104. Alternatively, internal seal element 138 may be formed from a robust material such as a natural or synthetic rubber or other suitable polymer such as a high polymer having the ability to partially or completely recover to its original shape after deforming forces are removed. In a particular embodiment, internal seal element 138 may be formed from nitrile rubber.

Figure 5:
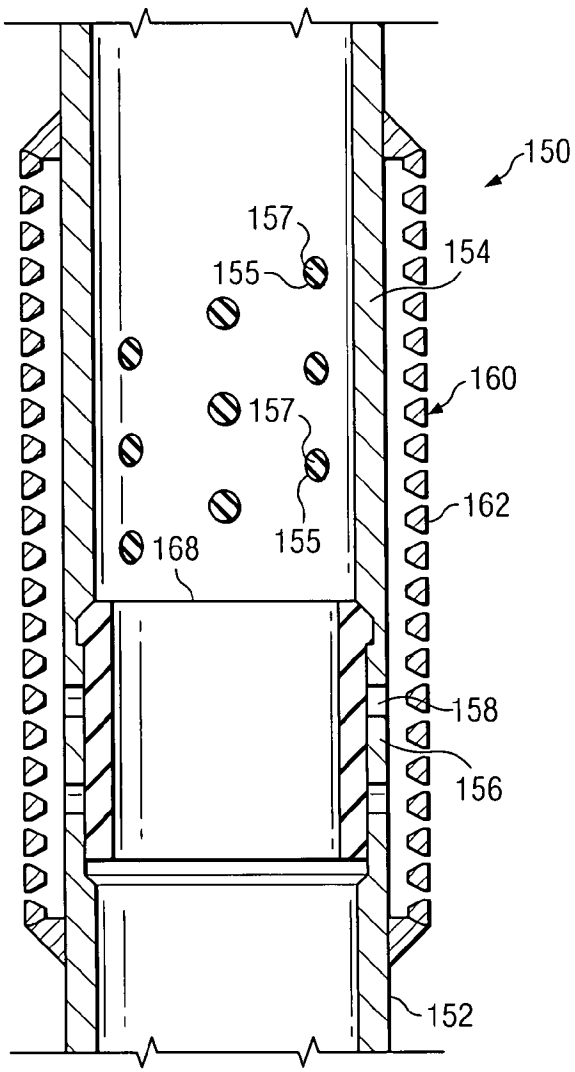
FIG. 5 is a cross sectional view of another alternate embodiment of a sand control screen assembly of the present invention having an internal seal element and production holes blocked by degradable plugs.

FIG. 5 illustrates a sand control screen assembly 150 in accordance with a particular embodiment of the present invention. Sand control screen assembly 150 includes base pipe 152 having a first perforated section 156 and a second perforated section 154. First perforated section 156 has a plurality of openings 158 to allow fluid flow from the exterior to the interior of sand control screen assembly 150. Second perforated section 154 has a plurality of openings 155 that are blocked by degradable plugs 157. Positioned on the exterior of base pipe 152 is a sand control screen jacket 160 including a plurality of ribs (not pictured) and a screen wire 162.

Positioned within base pipe 152 is an internal seal element 168 that prevents fluid flow from the interior to the exterior of the sand control screen assembly 150. Internal seal element 168 may be similar to any of internal seal elements 80, 104, or 138 discussed above. Therefore, internal seal element 168 may be made of a robust or dissolvable material, may or may not include slits (slits not illustrated), and may be anchored to base pipe 152 on one or both sides of internal seal element 168 (only one side is anchored in the illustration).

In operation, internal seal element 168 may operate as described above. Additionally, degradable plugs 157 may be degraded or dissolved (collectively "dissolved") after well completion or during production to allow fluid flow through openings 155. Degradable plugs 157 may be formed from a dissolvable material such as PLA; pliable water, oil, or gas soluble resin; or any other suitable dissolvable material. Degradable plugs 157 may be dissolved by exposing degradable plugs 157 to a solvent capable of dissolving the material of degradable plugs 157. Exposing degradable plugs 157 to a solvent may include, but is not limited to, circulating the solvent around degradable plugs 157, allowing the solvent to remain in contact with degradable plugs 157 for a length of time, or, when the solvent is a production fluid, by beginning or continuing production.

The material which degradable plugs 157 are formed from will at least partially determine when degradable plugs 157 will begin dissolving, and the material may be selected based on a desired life of degradable plugs 157. In certain embodiments the desired life of degradable plugs 157 may be approximately three weeks. In particular embodiments, the material of degradable plugs 157 may be dissolved by production fluids such as oil, gas, water, or other fluids present in the formation. Once production has commenced, the fluids being produced will flow around degradable plugs 157 thereby dissolving degradable plugs 157. Dissolving degradable plugs 157 after completion of the well will result a higher flow rate of the production fluids during production as the area for fluid flow is increased.

Alternatively, degradable plugs 157 may be selectively dissolvable by a fluid or treatment agent other than a production fluid. In this embodiment, a dissolving agent may be pumped downhole from the surface to circulate around and dissolve degradable plugs 157. This step may be performed after well completion and before production starts, or it may be completed after production has commenced to increase the flow rate of the production fluids. In particular embodiments, water is not produced from a formation and may be used to selectively dissolve degradable plugs 157.

When degradable plugs 157 are used in conjunction with internal seal element 168 formed from a dissolvable material, the degradable plugs 157 and the material used to form internal seal element 168 may be the same material or a different material. Choosing the same or different material for degradable plugs 157 and internal seal element 168 may result in degradable plugs 157 and internal seal element 168 being dissolvable by the same or different solvents. If degradable plugs 157 and internal seal element 168 are dissolvable by different solvents, one or the other of degradable plugs 157 and internal seal element 168 may be selectively dissolved before the other. The ability to dissolve one of degradable plugs 157 or internal seal element 168 before dissolving the other may allow for greater adjustability of the flow rate of production fluids during production. Even when degradable plugs 157 and internal seal element 168 are formed from the same material, the design of degradable plugs 157 and internal seal element 168 may be such that one dissolves more rapidly than the other, thereby providing a gradual increase in the area available for flow of production fluids.

While a particular number and arrangement of openings 155 and degradable plugs 157 has been illustrated in FIG. 5, the number and arrangement of openings 155 and degradable plugs 157 may be varied to achieve a desired area for fluid flow and/or a desired flow rate. Furthermore, more than one section of degradable plugs could be included in base pipe 152, the sections being dissolvable by the same or different solvents.

Figure 6:
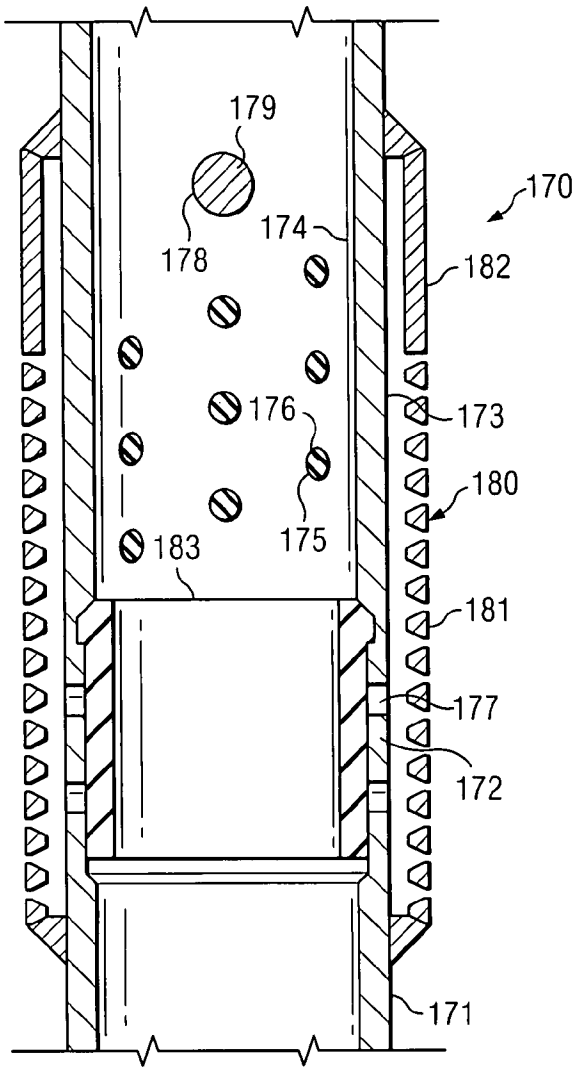
FIG. 6 is a cross sectional view of another alternate embodiment of a sand control screen assembly of the present invention having an internal seal element, production holes blocked by degradable plugs, and rupture discs.

FIG. 6 illustrates a sand control screen assembly 170 in accordance with a particular embodiment of the present invention. Sand control screen assembly 170 includes base pipe 171 having a first perforated section 172, a second perforated section 173, and a third perforated section 174. First perforated section 172 has a plurality of openings 177 to allow fluid flow from the exterior to the interior of sand control screen assembly 170. Second perforated section 173 has a plurality of openings 175 that are blocked by degradable plugs 176. Third perforated section 174 has an opening 178 that are blocked by a rupture disc 179. Positioned on the exterior of base pipe 170 is a sand control screen jacket 180 including a plurality of ribs (not pictured) and a screen wire 181. In the region adjacent to third perforated section 174 of base pipe 171, sand control screen jacket 180 includes an optional blank pipe section 182 to redirect fluid flow exiting openings 178 following the rupture of rupture disc 179.

Positioned within base pipe 171 is an internal seal element 183 that prevents fluid flow from the interior to the exterior of the sand control screen assembly 170. Internal seal element 183 may be similar to any of internal seal elements 80, 104, 138, or 168 discussed above. Therefore, internal seal element 183 may be made of a robust or dissolvable material, may or may not include slits (slits not illustrated), and may be anchored to base pipe 171 on one or both sides of internal seal element 183 (only one side is anchored in the illustration). Likewise, degradable plugs 176 and openings 175 may be similar to degradable plugs 157 and openings 155 described above.

In operation, internal seal element 183 and degradable plugs 176 may operate in a similar manner to those described above. Additionally, rupture disc 179 may be ruptured by increasing a pressure within base pipe 171 above a threshold rupture pressure of rupture disc 179. The threshold rupture pressure of rupture disc 179 may be chosen such that rupture disc 179 will rupture at a desired and predetermined pressure. When rupture disc 179 ruptures, fluid flow is established through opening 178. Initially, following rupture, the pressure within sand control screen assembly 170 will be greater than the pressure outside of sand control screen assembly 170. This may result in fluid flow through opening 178 from the interior to the exterior of sand control screen assembly 170. The differential pressure between the interior and exterior of sand control screen assembly 170 may be significant and may result in a high rate of fluid flow under great force through opening 178. Blank pipe section 182 may optionally be arranged, as illustrated, adjacent opening 178 to redirect the fluid flow out of opening 178 and thereby reduce the likelihood of damage to sand control screen jacket 180.

Rupture disc 179 may be ruptured for a variety of reasons. Opening 178 will increase the area for fluid flow and therefore rupture disc 179 may be ruptured to increase the flow rate of production fluids. Rupturing disc 179 may also allow a solvent (or solvents) to be circulated around degradable plugs 176 and internal seal element 183. This may be desirable when degradable plugs 176 or internal seal element 183 are not dissolving as quickly as desired or when degradable plugs 176 or internal seal element 183 are not dissolvable by production fluids and an increased flow rate is desired. In the example illustrated, rupture disc 179 is located at the opposite end of base pipe 171 from openings 177 such that a solvent flowing through opening 178 will be circulated past degradable plugs 176 and internal seal element 183. Furthermore, rupture disc 179 may be ruptured to further fracture the formation or provide greater treatment of the formation.

While one opening 178 and rupture disc 179 has been illustrated in FIG. 6, the number and arrangement of openings 178 and rupture discs 179 may be varied to achieve a variety of results. Furthermore, more than one section of rupture discs could be included in base pipe 171, the sections having the same or different threshold rupture pressures. A special device may be required to supply pressure to each section in isolation from other sections.

Figure 7:
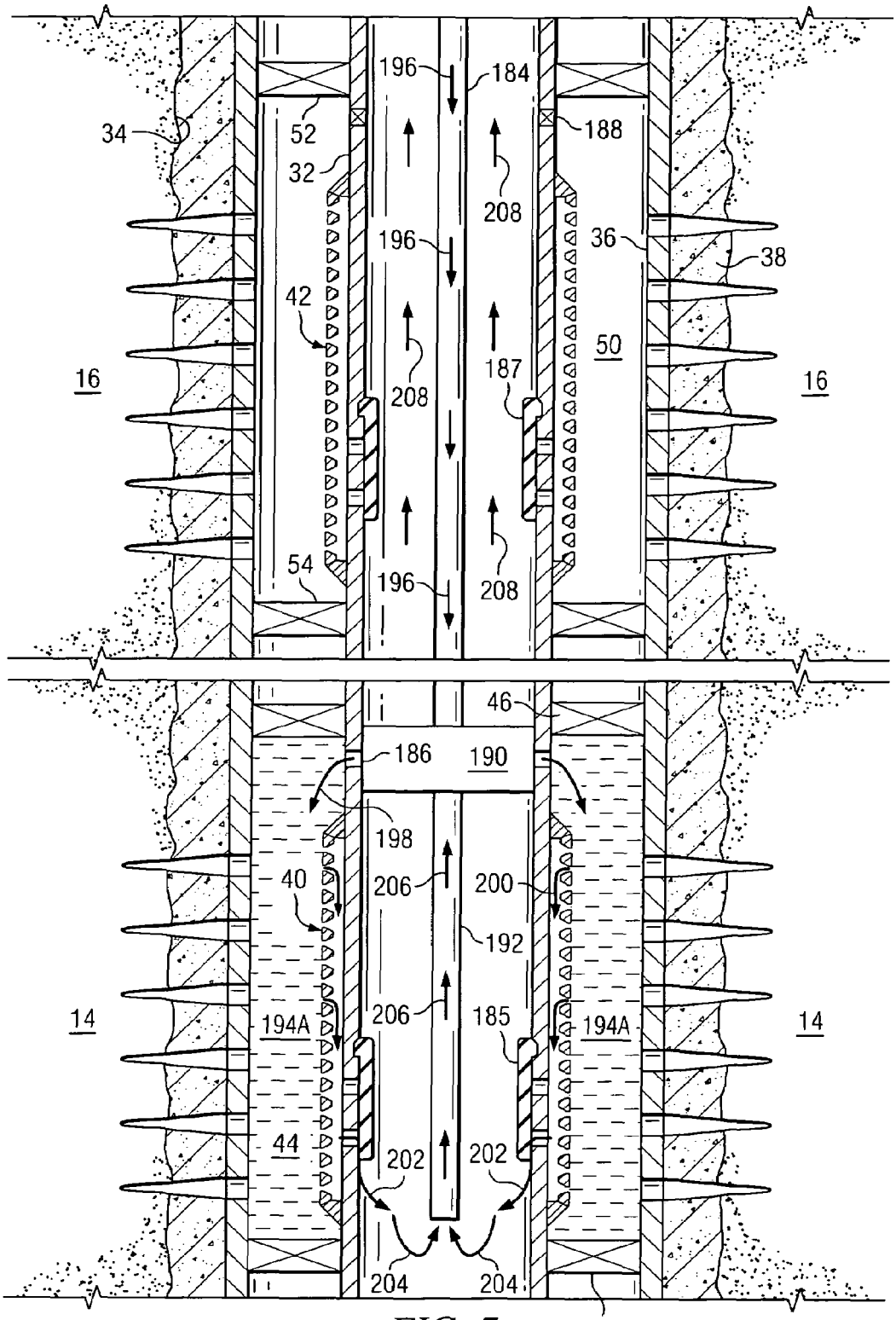
FIG. 7 is a half sectional view of a downhole production environment including a pair of sand control screen assemblies of the present invention during a first phase of a downhole treatment process.

Referring now to FIG. 7, therein is depicted in more detail the downhole environment described above with reference to FIG. 1 during a treatment process such as a gravel pack, a fracture operation, a frac pack or the like. As illustrated, sand control screen assembly 40 including internal seal element 185, is positioned within casing 36 and is adjacent to formation 14. Likewise, sand control screen assembly 42 including internal seal element 187, is positioned within casing 36 and is adjacent to formation 16. One or both of internal seal elements 185 and 187 may have similar composition and properties to any of internal seal elements 80, 104, 138, 168, or 183 described above. A service tool 184 is positioned within work string 32.

To begin the completion process, production interval 44 adjacent to formation 14 is isolated. Packer 46 seals the near or uphole end of production interval 44 and packer 48 seals the far or downhole end of production interval 44. Likewise, production interval 50 adjacent to formation 16 is isolated. Packer 52 seals the near end of production interval 50 and packer 54 seals the far end of production interval 50. Work string 32 includes cross-over ports 186, 188 that provide a fluid communication path from the interior of work string 32 to production intervals 44, 50, respectively. Preferably, fluid flow through cross-over ports 186, 188 is controlled by suitable valves that are opened and closed by conventional means. Service tool 184 includes a cross-over assembly 190 and a wash pipe 192.

Next, the desired treatment process may be performed. As an example, when the treatment process is a fracture operation, the objective is to enhance the permeability of the treated formation by delivering a fluid slurry containing proppants at a high flow rate and in a large volume above the fracture gradient of the formation such that fractures may be formed within the formation and held open by proppants. In addition, if the treatment process is a frac pack, after fracturing, the objective is to prevent the production of fines by packing the production interval with proppants. Similarly, if the treatment process is a gravel pack, the objective is to prevent the production of fines by packing the production interval with gravel, without fracturing the adjacent formation.

The following example will describe the operation of the present invention during a gravel pack operation. Sand control screen assemblies 40, 42 each have a filter medium associated therewith that is designed to allow fluid to flow therethrough but prevent particulate matter of a sufficient size from flowing therethrough. During the gravel pack, a treatment fluid, in this case a fluid slurry containing gravel 194, is pumped downhole in service tool 184, as indicated by arrows 196, and into production interval 44 via cross-over assembly 190, as indicated by arrows 198. As the fluid slurry containing gravel 194 travels to the far end of production interval 44, gravel 194 drops out of the slurry and builds up, filling the perforations and production interval 44 around sand control screen assembly 40 and forming gravel pack 194A. While some of the carrier fluid in the slurry may leak off into formation 14, the remainder of the carrier fluid enters sand control screen assembly 40, as indicated by arrows 200 and radially inwardly deforms internal seal element 185 to enter the interior of sand control screen assembly 40, as indicated by arrows 202. The fluid flowing back through sand control screen assembly 40, as indicated by arrows 204, enters wash pipe 192, as indicated by arrows 206, passes through cross-over assembly 190 and flows back to the surface, as indicated by arrows 208.

Figure 8:
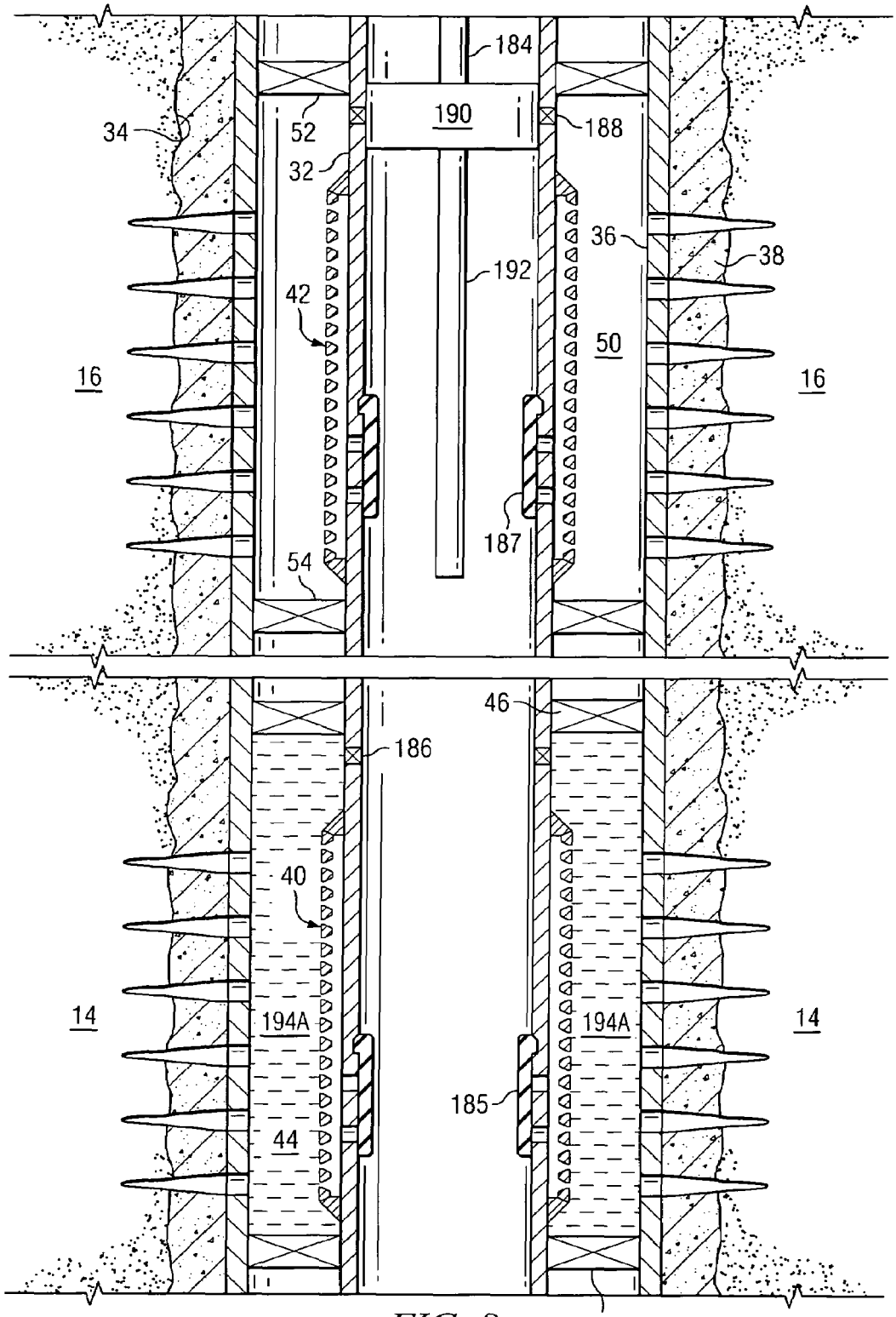
FIG. 8 is a half sectional view of a downhole product environment including a pair of sand control screen assemblies of the present invention during a second phase of a downhole treatment process.

After the gravel packing operation of production interval 44 is complete, service tool 184 including cross-over assembly 190 and wash pipe 192 may be moved uphole such that other production intervals may be gravel packed, such as production interval 50, as best seen in FIG. 8. As the distance between formation 14 and formation 16 may be hundreds or even thousands of feet and as there may be any number of production intervals that require gravel packing, there may be a considerable amount of time between the gravel packing of production interval 44 and eventual production from formation 14. It has been found that in conventional completions, considerable fluid loss may occur from the interior of sand control screen assembly 40 through gravel pack 194A and into formation 14. This fluid loss is not only costly but may also damage gravel pack 194A, formation 14 or both. Using sand control screen assembly 40, however, prevents such fluid loss due to internal seal element 185 positioned within sand control screen assembly 40. Accordingly, using sand control screen assembly 40 not only saves the expense associated with fluid loss, but also protects gravel pack 194A and formation 14 from the damage caused by fluid loss.

Figure 9:
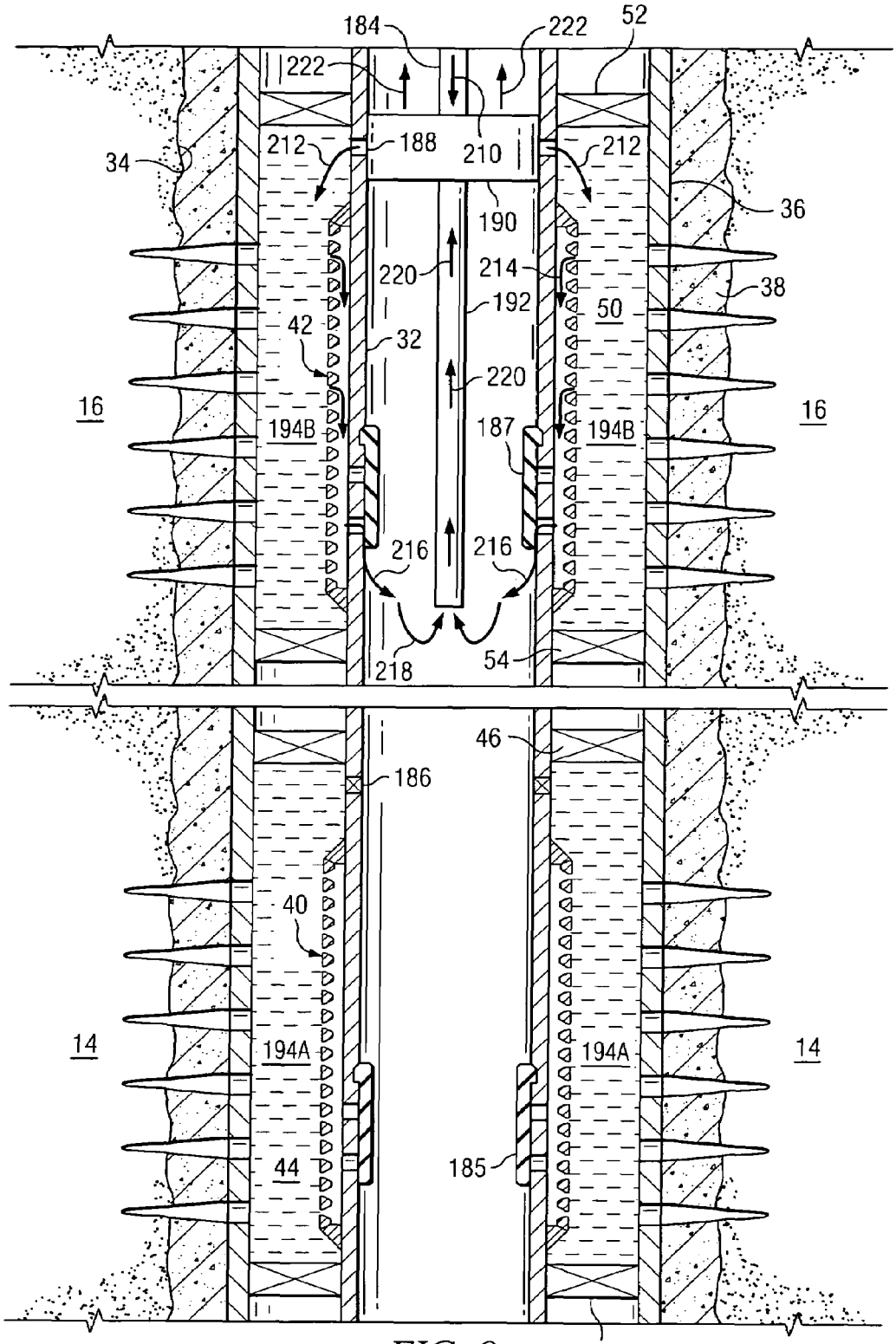
FIG. 9 is a half sectional view of a downhole production environment including a pair of sand control screen assemblies of the present invention during a third phase of a downhole treatment process.

Referring now to FIG. 9, the process of gravel packing production interval 50 is depicted. The fluid slurry containing gravel 194 is pumped downhole through service tool 184, as indicated by arrows 210, and into production interval 50 via cross-over assembly 190 and cross-over ports 188, as indicated by arrows 212. As the fluid slurry containing gravel 194 travels to the far end of production interval 50, the gravel 194 drops out of the slurry and builds up, filling the perforations and production interval 50 around sand control screen assembly 42 and forming gravel pack 194B. While some of the carrier fluid in the slurry may leak off into formation 16, the remainder of the carrier fluid enters sand control screen assembly 42, as indicated by arrows 214 and radially inwardly deforms internal seal element 187 to enter the interior of sand control screen assembly 42, as indicated by arrows 216. The fluid flowing back through sand control screen assembly 42, as indicated by arrows 218, enters wash pipe 192, as indicated by arrows 220, and passes through cross-over assembly 190 for return to the surface, as indicated by arrows 222. Once gravel pack 194B is complete, cross-over assembly 190 may again be repositioned uphole to gravel pack additional production intervals or retrieved to the surface. As explained above, using sand control screen assembly 42 prevents fluid loss from the interior of sand control screen assembly 42 into production interval 50 and formation 16 during such subsequent operations.

As should be apparent to those skilled in the art, even though FIGS. 7-9 present the treatment of multiple intervals of a wellbore in a vertical orientation with packers at the top and bottom of the production intervals, these figures are intended to also represent wellbores that have alternate directional orientations such as inclined wellbores and horizontal wellbores. In the horizontal orientation, for example, packer 46 is at the heel of production interval 44 and packer 48 is at the toe of production interval 44. Likewise, while multiple production intervals have been described as being treated during a single trip, the methods described above are also suitable for treating a single production interval traversed by a wellbore or may be accomplished in multiple trips into a wellbore.

Some or all of the embodiments of the present invention may enable injection for formation treatment (planned or unplanned), reservoir pressure maintenance, or other purpose after the completion has been installed, while still preventing fluid loss during the completion. This control of fluid loss during completion operations may simplify designs for other production tools (e.g., may eliminate the need for isolation ball valves and their associated shifting tools) or service tools (e.g., service tool string used for multiple zone completions). Certain embodiments of the present invention may be used in wells with concentric, or "smart" concentric strings for managing production/injection flow that are to be installed inside the sand screens across the production interval(s). Certain embodiments of the present invention may also be used in multiple zone wells without concentric strings and allow simplification of the completion process at lower cost. Embodiments of the present invention could also have potential applicability to any sand-controlled well and may provide cost savings over alternative sand control devices.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. A sand control screen assembly for use in a wellbore, comprising:

a tubular base pipe having a first perforated section, the first perforated section having at least a first opening that allows fluid flow therethrough;

an internal seal element disposed within an internal diameter of the tubular base pipe and positioned at least partially overlapping the first perforated section, the internal seal element able to control fluid flow through the first opening;

wherein the internal seal element is configured to allow fluid flow from an exterior of the tubular base pipe through the first opening when an exterior fluid pressure is sufficiently higher than an internal fluid pressure;

wherein the internal seal element includes a first material that is dissolvable by a first solvent, and wherein the internal seal element may be dissolved by exposing the internal seal element to the first solvent until the internal seal element no longer controls fluid flow through the first opening;

the tubular base pipe having a second perforated section, the second perforated section having at least a second opening;

a degradable plug disposed so as to prevent fluid flow through the second opening; and wherein the degradable plug includes a second material that is dissolvable by a second solvent, and wherein the degradable plug may be dissolved by exposing the degradable plug to the second solvent until the degradable plug no longer prevents fluid flow through the second opening.

2. The assembly of claim 1, wherein the second material is selected from the group consisting of polylactic acid (PLA), water soluble resin, oil soluble resin, and gas soluble resin.

3. A sand control screen assembly for use in a wellbore, comprising:

a tubular base pipe having a first perforated section, the first perforated section having at least a first opening that allows fluid flow therethrough;

an internal seal element disposed within an internal diameter of the tubular base pipe and positioned at least partially overlapping the first perforated section, the internal seal element able to control fluid flow through the first opening;

wherein the internal seal element is configured to allow fluid flow from an exterior of the tubular base pipe through the first opening when an exterior fluid pressure is sufficiently higher than an internal fluid pressure;

wherein the internal seal element includes a first material that is dissolvable by a first solvent, and wherein the internal seal element may be dissolved by exposing the internal seal element to the first solvent until the internal seal element no longer controls fluid flow through the first opening;

the tubular base pipe having a second perforated section, the second perforated section having at least a second opening; and a rupture disc disposed so as to prevent fluid flow through the second opening, wherein the rupture disc is designed to rupture when a pressure of a fluid within the base pipe exceeds a threshold pressure of the rupture disc, and wherein the rupturing of the rupture disc allows fluid flow through the second opening.

4. The assembly of claim 3, further comprising a protective housing assembly comprising a section of blank pipe disposed around an exterior diameter of the tubular base pipe and positioned over the second opening such that an annular space is formed between the tubular base pipe and the protective housing assembly.

5. The assembly of claim 3, wherein the rupture disc is disposed within the second opening, and wherein rupture of the rupture disc renders the second opening open to allow fluid flow from the exterior of the tubular base pipe to the interior of the tubular base pipe and from the interior of the tubular base pipe to the exterior of the tubular base pipe.

6. The assembly of claim 3, wherein the second perforated section is positioned at an opposite end of the tubular base pipe from the first perforated section, such that injection fluid introduced to the tubular base pipe may flow through the at least second opening and circulate past the first openings.

7. A sand control screen assembly for use in a wellbore, comprising:

a tubular base pipe having a first perforated section, the first perforated section having at least a first opening that allows fluid flow therethrough;

an internal seal element disposed within an internal diameter of the tubular base pipe and positioned at least partially overlapping the first perforated section, the internal seal element able to control fluid flow through the first opening;

wherein the internal seal element is configured to allow fluid flow from an exterior of the tubular base pipe through the first opening when an exterior fluid pressure is sufficiently higher than an internal fluid pressure;

wherein the internal seal element includes a first material that is dissolvable by a first solvent, and wherein the internal seal element may be dissolved by exposing the internal seal element to the first solvent until the internal seal element no longer controls fluid flow through the first opening;

wherein the internal seal element includes at least one longitudinal slit, the longitudinal slit allowing fluid flow through the first opening from the exterior to the interior of the tubular base pipe when an exterior fluid pressure outside of the base pipe is sufficiently higher than an interior fluid pressure inside of the base pipe to deform the internal seal element radially inwards and allow fluid flow through the longitudinal slit.

8. A sand control screen assembly for use in a wellbore, comprising:

a tubular base pipe having a first and second perforated sections, the first perforated section having at least a first opening that allows fluid flow therethrough, and the second perforated section having at least a second opening that allows fluid flow therethrough;

a degradable plug disposed so as to prevent fluid flow through the first opening;

wherein the degradable plug includes a first material that is dissolvable by a first solvent, and wherein the degradable plug may be dissolved by exposing the degradable plug to the first solvent until the degradable plug no longer prevents fluid flow through the first opening;

an internal seal element disposed within an internal diameter of the tubular base pipe and positioned at least partially overlapping the second perforated section, the internal seal element able to control fluid flow through the second opening; and wherein the internal seal element includes a second material that is dissolvable by a second solvent, and wherein the internal seal element may be dissolved by exposing the internal seal element to the second solvent until the internal seal element no longer controls fluid flow through the second opening.

9. The assembly of claim 8, wherein the second material is selected from the group consisting of polylactic acid (PLA), water soluble resin, oil soluble resin, and gas soluble resin.

10. The assembly of claim 8, further comprising:

the tubular base pipe having a third perforated section, the third perforated section having at least a third opening; and a rupture disc disposed so as to prevent fluid flow through the third opening, wherein the rupture disc is designed to rupture when a pressure of a fluid within the base pipe exceeds a threshold pressure of the rupture disc, and wherein the rupturing of the rupture disc allows fluid flow through the third opening.

11. The assembly of claim 10, further comprising a protective housing assembly disposed around an exterior diameter of the tubular base pipe and positioned over the third opening such that an annular space is formed between the tubular base pipe and the protective housing assembly.

12. A sand control screen assembly for use in a wellbore, comprising:

a tubular base pipe having a first, second and third perforated sections, the first perforated section having at least a first opening that allows fluid flow therethrough, the second perforated section having at least a second opening that allows fluid flow therethrough, the third perforated section having at least a third opening that allows fluid flow therethrough;

an internal seal element disposed within an internal diameter of the tubular base pipe and positioned at least partially overlapping the first perforated section, the internal seal element able to control fluid flow through the first opening;

wherein the internal seal element includes a first material that is dissolvable by a first solvent, and wherein the internal seal element may be dissolved by exposing the internal seal element to the first solvent until the internal seal element no longer controls fluid flow through the first opening;

wherein before the internal seal element is dissolved, the internal seal element prevents fluid flow from the interior to the exterior of the tubular base pipe through the first opening and allows fluid flow from the exterior to the interior of the tubular base pipe through the first opening;

a degradable plug disposed so as to prevent fluid flow through the second opening, wherein the degradable plug includes a second material that is dissolvable by a second solvent, and wherein the degradable plug may be dissolved by exposing the degradable plug to the second solvent until the degradable plug no longer prevents fluid flow through the second opening;

wherein the first and second materials are selected from the group consisting of polylactic acid (PLA), oil soluble resin, and gas soluble resin;

a rupture disc disposed so as to prevent fluid flow through the third opening, wherein the rupture disc is designed to rupture when a pressure of a fluid within the base pipe exceeds a threshold pressure of the rupture disc, and wherein the rupturing of the rupture disc allows fluid flow through the third opening; and a protective housing assembly disposed around an exterior diameter of the tubular base pipe and positioned over the third opening such that an annular space is formed between the tubular base pipe and the protective housing assembly.

13. A method of controlling fluid flow through a sand control screen assembly in a wellbore, comprising:

forming at least a first opening in a first perforated section of a tubular base pipe, the first opening allowing fluid flow therethrough;

disposing an internal seal element within an internal diameter of the tubular base pipe, the internal seal element positioned at least partially overlapping the first perforated section, the internal seal element able to control fluid flow through the first opening, the internal seal element configured to allow fluid flow from an exterior of the tubular base pipe through the first opening when an exterior fluid pressure is sufficiently higher than an internal fluid pressure, the internal seal element including a first material that is dissolvable by a first solvent, and wherein the internal seal element may be dissolved by exposing the internal seal element to the first solvent until the internal seal element no longer controls fluid flow through the first opening;

forming at least a second opening in a second perforated section of the tubular base pipe; and installing a degradable plug in the second opening to prevent fluid flow through the second opening, the degradable plug including a second material that is dissolvable by a second solvent, and wherein the degradable plug may be dissolved by exposing the degradable plug to the second solvent until the degradable plug no longer prevents fluid flow through the second opening.

14. A method of controlling fluid flow through a sand control screen assembly in a wellbore, comprising:

forming at least a first opening in a first perforated section of a tubular base pipe, the first opening allowing fluid flow therethrough;

disposing an internal seal element within an internal diameter of the tubular base pipe, the internal seal element positioned at least partially overlapping the first perforated section, the internal seal element able to control fluid flow through the first opening, the internal seal element configured to allow fluid flow from an exterior of the tubular base pipe through the first opening when an exterior fluid pressure is sufficiently higher than an internal fluid pressure, the internal seal element including a first material that is dissolvable by a first solvent, and wherein the internal seal element may be dissolved by exposing the internal seal element to the first solvent until the internal seal element no longer controls fluid flow through the first opening;

forming at least a second opening in a second perforated section of the tubular base pipe; and installing a rupture disc in the second opening so as to prevent fluid flow through the second opening, wherein the rupture disc is designed to rupture when a pressure of a fluid within the base pipe exceeds a threshold pressure of the rupture disc, and wherein the rupturing of the rupture disc allows fluid flow through the second opening.

15. The method of claim 14, further comprising installing a protective housing assembly comprising a section of blank pipe around an exterior diameter of the tubular base pipe, the protective housing assembly positioned over the second opening such that an annular space is formed between the tubular base pipe and the protective housing assembly.

16. The method of claim 14, further comprising rupturing the rupture disc, thereby rendering the second opening open to allow fluid flow from the exterior of the tubular base pipe to an interior of the tubular base pipe and from the interior of the tubular base pipe to the exterior of the tubular base pipe.

17. The method of claim 14, wherein the second perforated section is positioned at an opposite end of the tubular base pipe from the first perforated section, such that injection fluid introduced to the tubular base pipe may flow through the at least second opening and circulate past the first openings.

18. A method of controlling fluid flow through a sand control screen assembly in a wellbore, comprising:

forming at least a first opening in a first perforated section of a tubular base pipe, the first opening allowing fluid flow therethrough;

disposing an internal seal element within an internal diameter of the tubular base pipe, the internal seal element positioned at least partially overlapping the first perforated section, the internal seal element able to control fluid flow through the first opening, the internal seal element configured to allow fluid flow from an exterior of the tubular base pipe through the first opening when an exterior fluid pressure is sufficiently higher than an internal fluid pressure, the internal seal element including a first material that is dissolvable by a first solvent, and wherein the internal seal element may be dissolved by exposing the internal seal element to the first solvent until the internal seal element no longer controls fluid flow through the first opening; and forming at least one longitudinal slit in the internal seal element, the longitudinal slit allowing fluid flow through the first opening from the exterior to the interior of the tubular base pipe when an exterior fluid pressure outside of the base pipe is sufficiently higher than an interior fluid pressure inside of the base pipe to deform the internal seal element radially inwards and allow fluid flow through the longitudinal slit.

19. A method of controlling fluid flow through a sand control screen assembly in a wellbore, comprising:

forming at least a first opening in a first perforated section of a tubular base pipe, the first opening allowing fluid flow therethrough;

installing a degradable plug in the first opening to prevent fluid flow through the first opening, the degradable plug including a first material that is dissolvable by a first solvent, and wherein the degradable plug may be dissolved by exposing the degradable plug to the first solvent until the degradable plug no longer prevents fluid flow through the first opening;

forming at least a second opening in a second perforated section of the tubular base pipe; and installing an internal seal element within an internal diameter of the tubular base pipe, the internal seal element positioned at least partially overlapping the second perforated section, the internal seal element able to control fluid flow through the second opening, the internal seal element including a second material that is dissolvable by a second solvent, and wherein the internal seal element may be dissolved by exposing the internal seal element to the second solvent until the internal seal element no longer controls fluid flow through the second opening.

20. The method of claim 19, further comprising:

forming at least a third opening in a third perforated section of the tubular base pipe; and installing a rupture disc in the third opening to prevent fluid flow through the third opening, the rupture disc being designed to rupture when a pressure of a fluid within the base pipe exceeds a threshold pressure of the rupture disc, and wherein the rupturing of the rupture disc allows fluid flow through the third opening.

21. The method of claim 20, further comprising installing a protective housing assembly around an exterior diameter of the tubular base pipe, the protective housing assembly positioned over the third opening such that an annular space is formed between the tubular base pipe and the protective housing assembly.

* * * * *